US010669754B2

(12) United States Patent
Lizotte

(10) Patent No.: US 10,669,754 B2
(45) Date of Patent: Jun. 2, 2020

(54) DOOR-LOCKING SYSTEM

(71) Applicant: ROUSSEAU MÉTAL INC., Saint-Jean-Port-Joli (CA)

(72) Inventor: Gerry Lizotte, Saint-Agapit (CA)

(73) Assignee: ROUSSEAU MÉTAL INC., Saint-Jean-Port-Joli, Québec (CA)

( * ) Notice: Subject to any disclaimer, the term of this patent is extended or adjusted under 35 U.S.C. 154(b) by 386 days.

(21) Appl. No.: 15/514,094

(22) PCT Filed: Sep. 28, 2015

(86) PCT No.: PCT/CA2015/050969
§ 371 (c)(1),
(2) Date: Mar. 24, 2017

(87) PCT Pub. No.: WO2016/044953
PCT Pub. Date: Mar. 31, 2016

(65) Prior Publication Data

US 2017/0292300 A1 Oct. 12, 2017

(30) Foreign Application Priority Data

Sep. 26, 2014 (CA) ..... 2865344

(51) Int. Cl.
*E05C 9/04* (2006.01)
*E05B 13/00* (2006.01)
(Continued)

(52) U.S. Cl.
CPC ..... *E05C 9/047* (2013.01); *E05B 13/002* (2013.01); *E05B 13/10* (2013.01); *E05B 65/44* (2013.01);
(Continued)

(58) Field of Classification Search
CPC ..... E05C 9/047; E05C 9/042; E05C 9/043; E05C 9/10; E05B 13/002; E05B 13/10;
(Continued)

(56) References Cited

U.S. PATENT DOCUMENTS 859,531 A * 7/1907 Strauss ..... E05B 63/20 292/153
2,875,918 A * 3/1959 Baumier ..... E05C 9/06 220/323
(Continued)

FOREIGN PATENT DOCUMENTS

CA 2 233 094 A1 9/1998
WO 2009/012512 A1 1/2009

OTHER PUBLICATIONS

International Search Report and Written Opinion of the International Searching Authority for corresponding International Patent Application No. PCT/CA2015/050969 dated Jan. 12, 2016, 8 pgs.

*Primary Examiner* — Kristina R Fulton
*Assistant Examiner* — Faria F Ahmad
(74) *Attorney, Agent, or Firm* — Merchant & Gould P.C.

(57) ABSTRACT

A door-locking mechanism is for locking a door of a cabinet with respect to a main body of the cabinet. The door-locking mechanism includes a supporting component being operatively mountable onto the door, a driving component being operatively moveable with respect to the supporting component between at least first and second configurations, and at least one transmission component being operatively moveable with respect to the supporting component between drawn-in and drawn-out configurations. The door-locking mechanism also includes at least one locking rod being operatively connectable to the at least one transmission component and being movable between disengaged and engaged configurations with respect to a corresponding catch-rod of the cabinet, in response to the at least one
(Continued)

transmission component being operated between the drawn-in and drawn-out configurations respectively, via an operation of the driving component from the first to the second configuration.

17 Claims, 13 Drawing Sheets

(51) Int. Cl.
*E05B 13/10* (2006.01)
*E05B 65/44* (2006.01)
*E05B 65/02* (2006.01)
*E05C 9/10* (2006.01)

(52) U.S. Cl.
CPC ..... *E05C 9/042* (2013.01); *E05C 9/043* (2013.01); *E05B 65/02* (2013.01); *E05C 9/10* (2013.01); *Y10T 292/084* (2015.04); *Y10T 292/0834* (2015.04); *Y10T 292/0836* (2015.04); *Y10T 292/0839* (2015.04); *Y10T 292/0844* (2015.04); *Y10T 292/0845* (2015.04); *Y10T 292/0846* (2015.04); *Y10T 292/096* (2015.04); *Y10T 292/0962* (2015.04); *Y10T 292/0963* (2015.04); *Y10T 292/0967* (2015.04); *Y10T 292/0968* (2015.04)

(58) Field of Classification Search
CPC .... E05B 65/44; E05B 65/02; Y10T 292/0834; Y10T 292/0836; Y10T 292/0839; Y10T 292/084; Y10T 292/0844; Y10T 292/0845; Y10T 292/0846; Y10T 292/096; Y10T 292/0962; Y10T 292/0963; Y10T 292/0967; Y10T 292/0968
See application file for complete search history.

(56) References Cited

U.S. PATENT DOCUMENTS 3,183,027 A * 5/1965 Powers ..... E05C 9/02 292/254
4,114,933 A * 9/1978 Jankelewitz ..... E05C 9/06 292/37
4,154,070 A * 5/1979 Bahry ..... E05C 9/06 292/142
4,192,535 A * 3/1980 Picard ..... E05C 9/045 292/159
4,223,943 A * 9/1980 VanHulle ..... B60J 7/194 292/337
4,263,795 A * 4/1981 Van Gompel ..... E05C 1/08 292/167
4,306,432 A * 12/1981 Ravid ..... E05C 9/06 292/34
4,362,328 A * 12/1982 Tacheny ..... E05C 9/043 292/36
4,387,917 A * 6/1983 Cocker ..... E05B 63/20 292/40
4,639,021 A * 1/1987 Hope ..... E05C 9/043 292/40
4,984,832 A * 1/1991 Canepa ..... E05C 9/06 292/36
5,029,909 A * 7/1991 Bunger ..... E05B 67/383 292/40
5,071,176 A * 12/1991 Smith ..... E05C 9/06 292/42
5,074,627 A 12/1991 Broeders
5,350,207 A * 9/1994 Sanders ..... E05B 15/0245 292/335
5,778,708 A * 7/1998 Crosby ..... E05B 65/0075 109/59 R
5,911,763 A * 6/1999 Quesada ..... E05C 9/043 292/36
5,938,248 A * 8/1999 Vickers ..... E05B 5/00 292/23
6,065,314 A * 5/2000 Nicholson ..... E05B 67/383 292/218
6,508,087 B2 1/2003 Lemley et al.
7,404,306 B2 * 7/2008 Walls ..... E05C 9/20 292/139
7,775,564 B2 * 8/2010 Moore ..... E05B 13/001 220/730
8,763,836 B2 * 7/2014 Becklin ..... B65D 21/0223 220/210
9,284,759 B2 * 3/2016 Raatikainen ..... E05C 9/20
2008/0141738 A1 6/2008 Chang
2017/0159335 A1 * 6/2017 Goldman ..... E05B 47/06
2018/0155962 A1 * 6/2018 Mitchell ..... E05C 9/042

* cited by examiner

DOOR-LOCKING SYSTEM

This application is a National Stage Application of PCT/CA2015/050969, filed 28 Sep. 2015, which claims benefit of Serial No. 2,865,344, filed 26 Sep. 2014, in Canada and which applications are incorporated herein by reference. To the extent appropriate, a claim of priority is made to each of the above disclosed applications.

FIELD OF THE INVENTION

The present invention relates to a locking system. More particularly, and according to a possible embodiment, the present invention relates to a door-locking system, to a corresponding door-handle and/or door-locking mechanism, to a door assembly and/or storage container provided with such a system and/or mechanism, to a kit with corresponding components for assembling the same, and to corresponding methods of assembling and/or operating associated thereto.

BACKGROUND

Door-locking systems for storage containers, such as cabinets, for example, that operate with a door-handle mechanism, are well known in the art.

As illustrated in FIGS. 1 and 2, for example, these mechanisms generally consist of a fixed portion mounted onto the door, in which is inserted a pivoting part which is driven in rotation by a user in order to activate the locking rods. The pivoting part can be actuated only in a clockwise direction and it is brought back to its initial position by means of a torsion spring when the handle is released. A lock can be added in order to prevent the rotation of the central part of the door-handle mechanism, thus blocking the locking rods in the corresponding holes located in the upper part and the lower part of the cabinet. In order to close the door, the handle must be pivoted once again so that the locking rods can be inserted into the holes of the casing.

Also known in the art are the different disadvantages and drawbacks associated with such conventional systems, namely, the fact that they cannot be used in an easy, efficient and/or versatile manner for different applications.

Among other things, the existing systems present one or a combination of several of the following drawbacks: a) the mechanism can only be activated in one single direction (ex. clockwise direction); b) the mechanism must be activated manually once again in order to close the door; c) the manufacturing of locking rod with via bending process is complex and costly; d) vibrations tend to occur in the locking rods when they are used on doors of greater dimensions; e) the difficulty of installing the mechanism in doors that are relatively thin; etc.

Thus, it would be particularly useful to be able to provide an improved system which, by virtue of its design and components, would be able to overcome or at least minimize some of the aforementioned drawbacks of the prior art associated with conventional systems.

SUMMARY OF THE INVENTION

An object of the present invention is to provide a door-locking system which, by virtue of its design and components, satisfies some of the above-mentioned need(s) and which is thus an improvement over other related door-locking systems and/or methods known in the prior art.

In accordance with the present invention, the above object is achieved, as will be easily understood from the present description, with a door-locking system (also referred to herein as a "door-locking mechanism") such as the one briefly described herein and such as the one exemplified in the accompanying drawings.

More particularly, according to one aspect of the present invention, there is provided a door-locking mechanism for locking a door of a cabinet with respect to a main body of said cabinet, the door-locking mechanism comprising:

a supporting component being operatively mountable onto the door;

a driving component being operatively moveable with respect to the supporting component between at least first and second configurations;

at least one transmission component being operatively moveable with respect to the supporting component between drawn-in and drawn-out configurations; and at least one locking rod being operatively connectable to the at least one transmission component and being movable between disengaged and engaged configurations with respect to a corresponding catch-rod of the cabinet, in response to the at least one transmission component being operated between the drawn-in and drawn-out configurations respectively, via an operation of the driving component from the first to the second configuration.

According to another aspect of the present invention, there is provided a door assembly provided with the above-mentioned door-locking system and/or mechanism.

According to another aspect of the present invention, there is provided a storage container (ex. a cabinet) provided with the above-mentioned door-locking system, mechanism, and/or door assembly.

According to another aspect of the invention, there is also provided a method of assembling and/or mounting the above-mentioned door-locking system and/or mechanism onto a corresponding door assembly and/or storage container.

According to yet another aspect of the invention, there is also provided a method of using the above-mentioned door-locking system, mechanism, door assembly and/or storage container.

According to yet another aspect of the invention, there is also provided a kit with components for assembling the above-mentioned door-locking system, mechanism, door assembly and/or storage container.

According to yet another aspect of the present invention, there is also provided a set of components for interchanging with components of the above-mentioned kit.

According to yet another aspect of the present invention, there is also provided a method of assembling components of the above-mentioned kit and/or set.

According to yet another aspect of the present invention, there is also provided a method of doing business with the above-mentioned door-locking system, mechanism, door assembly, storage container, components thereof, kit, set and/or method(s).

The objects, advantages, and other features of the present invention will become more apparent upon reading of the following non-restrictive description of preferred embodiments thereof, given for the purpose of exemplification only, with reference to the accompanying drawings.

BRIEF DESCRIPTION OF THE ACCOMPANYING DRAWINGS

DETAILED DESCRIPTION OF POSSIBLE EMBODIMENTS OF THE INVENTION

Figure 1:
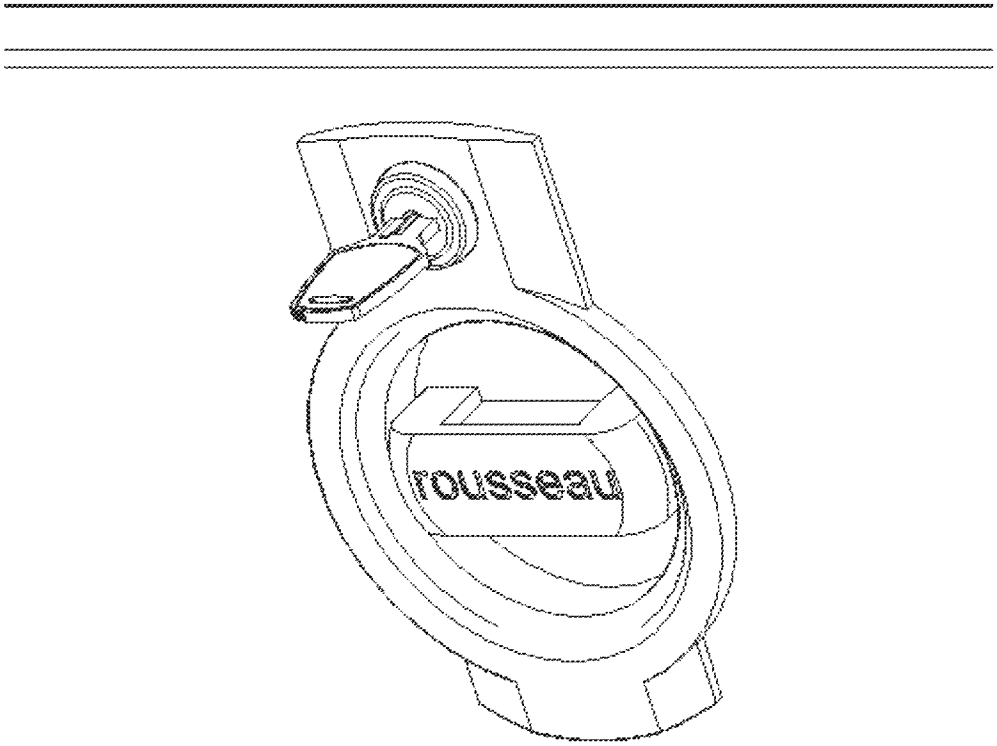
FIG. 1 is a perspective view of a door-locking system assembled onto a door of a storage space according to the prior art.
Figure 2:
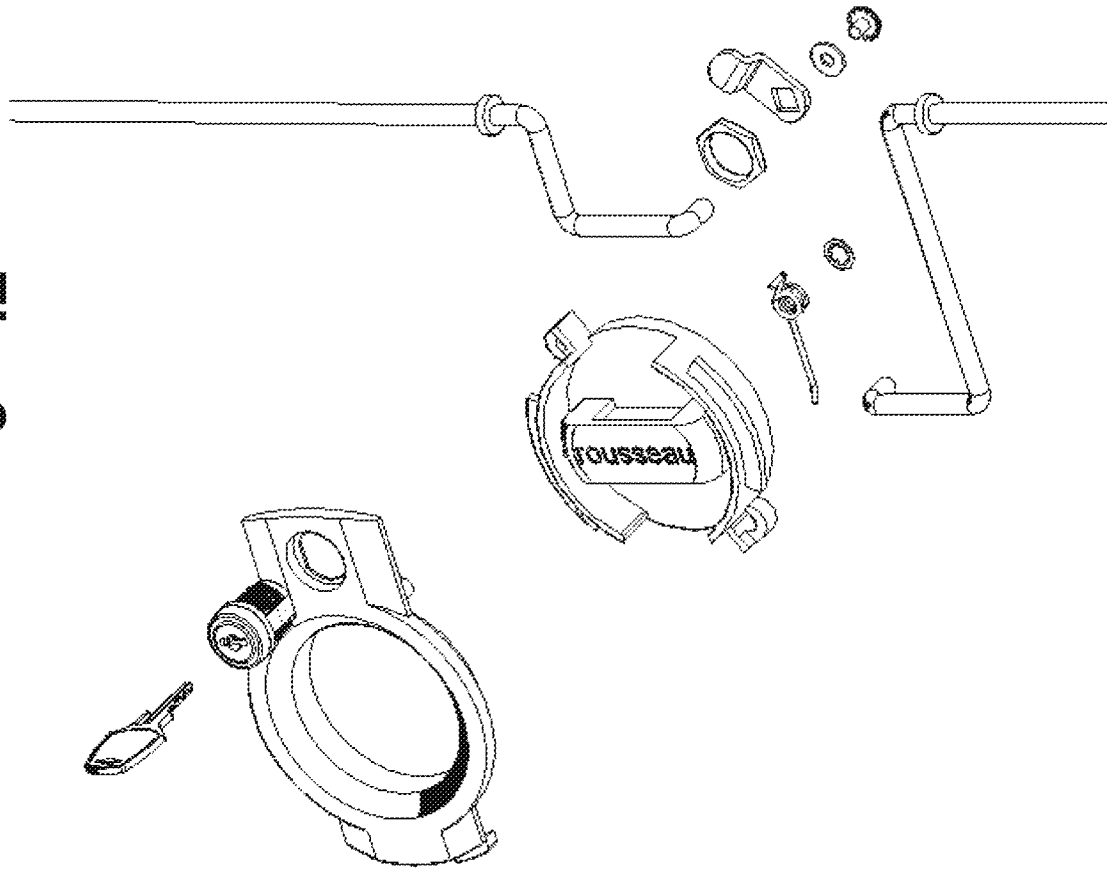
Fig. 2 (Prior Art)
FIG. 2 is an exploded view of the door-locking system shown in FIG. 1.
Figure 3:
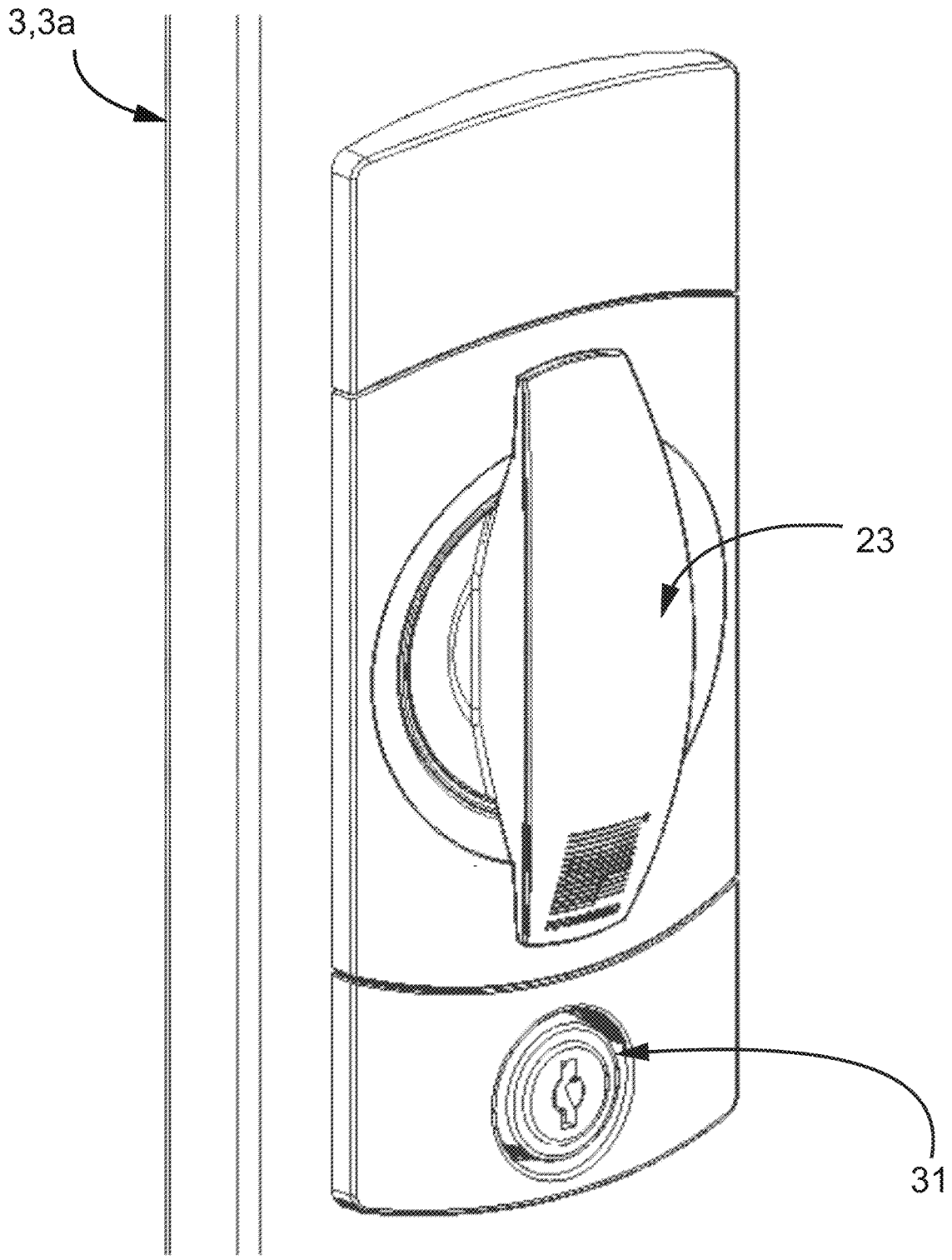
FIG. 3 is a perspective view of the door-locking system assembled onto a door and provided with at least one lock according to a possible embodiment of the present invention.

In the following description, the same numerical references refer to similar elements. Furthermore, for sake of simplicity and clarity, namely so as to not unduly burden the figures with several reference numbers, only some figures have been provided with reference numbers, and components and features of the present invention illustrated in other figures can be easily inferred therefrom. The embodiments, geometrical configurations, materials mentioned and/or dimensions shown in the figures are preferred, for exemplification purposes only.

Moreover, although the present invention was primarily designed for use with a storage space or container, such as a cabinet and/or the like, for example, it may be used with other objects and/or in other types of applications, as apparent to a person skilled in the art. For this reason, expressions such as "storage", "closed", "substantially closed", "space", "container", "box", "cabinet", etc., used herein should not be taken so as to limit the scope of the present invention and include all other kinds of objects (ex. access doors for people, garage doors, etc.) and/or applications with which the present invention could be used and may be useful.

Moreover, in the context of the present invention, the expressions "lock", "system", "mechanism", "device", "apparatus", "product", "unit", "equipment", "assembly", "tool", "method" and "kit", as well as any other equivalent expressions and/or compounds word thereof known in the art will be used interchangeably, as apparent to a person skilled in the art. This applies also for any other mutually equivalent expressions, such as, for example: a) "first degree-of-freedom", "first path", "first movement", "first actuating", "first driving", "first transmission", etc.; b) "second degree-of-freedom", "second path", "second movement", "second actuating", "second driving", "second transmission", etc.; c) "third degree-of-freedom", "third path", "third movement", "third actuating", "third driving", "third transmission", etc.; d) "connected", "secured", "mounted", "fastened", "attached", "riveted", "interconnected", "interlocked", etc.; e) "hinge", "pivot", "rotation", "axis", etc.; f) "moveable", "displaceable", "adjustable", "sliding", "gliding", "rotating", "skidding", "relatively", etc.; g) "track", "rail", "guide", "path", etc.; h) "securing", "restraining", "affixing", "holding", "fastening", "adjusting", etc.; i) "cavity", "recess", "hole", "groove", "slot", "slit", "notch", etc.; j) "fastener", "connector", "rivet", "clip", "lock", "interconnect", "interlock", "press-fit", etc.; k) "bolt", "latch", "lock", "blocker", etc.; l) "drawn-in", "brought together", "brought closer", etc.; as well as for any other mutually equivalent expressions, pertaining to the aforementioned expressions and/or to any other structural and/or functional aspects of the present invention, as also apparent to a person skilled in the art.

Furthermore, in the context of the present description, it will be considered that all elongated objects will have an implicit "longitudinal axis" or "centerline", such as the longitudinal axis of shaft for example, or the centerline of a coiled spring, for example, and that expressions such as "connected" and "connectable", or "mounted" and "mountable", may be interchangeable, in that the present invention also relates to a kit with corresponding components for assembling a resulting fully-assembled and operational door-locking system and/or mechanism (and/or door assembly and/or storage container, such as a cabinet for example, including the same, etc.).

Moreover, components of the present system(s) and/or steps of the method(s) described herein could be modified, simplified, altered, omitted and/or interchanged, without departing from the scope of the present invention, depending on the particular applications which the present invention is intended for, and the desired end results, as briefly exemplified herein and as also apparent to a person skilled in the art.

In addition, although the preferred embodiments of the present invention as illustrated in the accompanying drawings comprise various components, and although the preferred embodiments of the door-locking system and corresponding parts as shown consist of certain geometrical configurations, as explained and illustrated herein, not all of these components and geometries are essential to the invention and thus should not be taken in their restrictive sense, i.e. should not be taken so as to limit the scope of the present invention. It is to be understood, as also apparent to a person skilled in the art, that other suitable components and cooperation thereinbetween, as well as other suitable geometrical configurations may be used for the door-locking system and corresponding parts according to the present invention, as will be briefly explained herein and as can be easily inferred herefrom by a person skilled in the art, without departing from the scope of the present invention.

LIST OF NUMERICAL REFERENCES FOR SOME OF THE CORRESPONDING POSSIBLE COMPONENTS ILLUSTRATED IN THE ACCOMPANYING DRAWINGS

1. door-locking mechanism
3. cabinet
3*a*. door (of cabinet)
3*b*. main body (of cabinet)
3*c*. edge (of cabinet)
5. supporting component
7. driving component
7*a*. first actuating component (of driving component)
7*b*. second actuating component (of driving component)
7*c*. axial actuating component (of driving component)
7*d*. hub portion (of driving component)
9. transmission component (ex. activation plate)
9*a*. first (or "upper") transmission component
9*b*. second (or "lower") transmission component
11. locking rod
11*a*. first (or "upper") locking rod
11*b*. second (or "lower") locking rod
13. catch-rod
15. direction(s)
15*a*. clockwise rotational direction
15*b*. anticlockwise rotational direction
17. slot (of driving component)
17*a*. first side slot (of driving component)
17*b*. second side slot (of driving component)
17*c*. central slot (of driving component)
19. other component
21. fastener (for handle)
23. handle
25. biasing component (ex. spring)
25*a*. first extremity (of biasing component)
25*b*. second extremity (of biasing component)
27. covering component
27*a*. first (or "front") covering component
27*b*. second (or "rear") covering component
29. section (of covering component)
29*c*. main section (of covering component)
29*d*. complementary/interchangeable section (of covering component)
31. lock
33. orifice (for lock)
35. bolt (of lock)
35*a*. first distal end (of bolt)
35*b*. second distal end (of bolt)
37. abutment component (of transmission component)
37*a*. first abutment component
37*b*. second abutment component
39. other component
41. track (of transmission component)
43. fastener (for bolt)
45. catch-rod guide
45*a*. slit (of catch-rod guide)
45*b*. clip (of catch-rod guide)
45*c*. rib (of catch-rod guide)
45*d*. channel (of catch-rod guide)
47. recess (of main body of cabinet)
49. notch (of main body of cabinet)
51. guiding clip (for locking rod)
53. retaining clip Broadly described, and as better exemplified in the accompanying drawings, the present invention relates to a door-locking system and/or mechanism (1) intended to "lock" (i.e. secure, anchor, affix, hold, maintain, stop, block, etc.) a door with respect to a corresponding main body of a storage container (ex. a cabinet and/or the like, etc.), in a simpler, easier, faster, more cost-effective and/or more reliable manner, than what is possible with other conventional systems.

The present door-locking system and/or mechanism (1) may come in various shapes and/or forms, and may include one and/or several of the following components and features (and/or different combination(s) thereof, etc.).

In accordance with one possible aspect of the present system, there is provided a door-locking mechanism (1) for locking a door (3*a*) of a cabinet (3) with respect to a main body (3*b*) of said cabinet (3), the door-locking mechanism (1) comprising: a supporting component (5) being operatively mountable onto the door (3*a*); a driving component (7) being operatively moveable with respect to the supporting component (5) between at least first and second configurations; at least one transmission component (9) being operatively moveable with respect to the supporting component (5) between drawn-in and drawn-out configurations; and at least one locking rod (11) being operatively connectable to the at least one transmission component (9) and being movable between disengaged and engaged configurations with respect to a corresponding catch-rod (13) of the cabinet (3), in response to the at least one transmission component (9) being operated between the drawn-in and drawn-out configurations respectively, via an operation of the driving component (7) from the first to the second configuration.

As can be easily understood from the accompanying drawings, the driving component (7) may be pivotably mountable with respect to the support component (5), and rotatable with respect to said support component (5) along at least one direction (15). Preferably, the driving component (7) is pivotably mountable with respect to the support component (5), and is rotatable with respect to said support component (5) along opposite first and second directions (15*a*, 15*b*) (ex. clockwise and anticlockwise directions).

As exemplified in the drawings, the driving component (7) may comprise a first actuating component (7*a*) positioned, shaped and sized for engaging a corresponding portion of a first transmission component (9*a*) of the door-locking mechanism (1).

According to one possible embodiment, the first actuating component (7*a*) of the driving component (7) may include a male component insertable into a corresponding female component of the first transmission component (9*a*) of the door-locking mechanism (1). Conversely, the first actuating component (7*a*) of the driving component (7) may include a female component configured for receiving a corresponding male component of the first transmission component (9*a*).

Optionally, the driving component (7) may comprises a second actuating component (7*b*) positioned, shaped and sized for engaging another corresponding portion of a second transmission component (9*b*) of the door-locking mechanism (1).

Similarly to the above-described, the second actuating component (7*b*) of the driving component (7) may include a male component insertable into a corresponding female component of the second transmission component (9*b*) of the door-locking mechanism (1). Conversely, the second actuating component (7*b*) of the driving component (7) may include a female component configured for receiving a corresponding male component of the first transmission component (9*a*).

According to one possible embodiment of the present system, each one of the first and second actuating components (7*a*,7*b*) of the driving component (7) is further positioned, shaped and sized for engaging a corresponding portion of both the first and second transmission components (9*a*,9*b*) of the door-locking mechanism (1), and for instance, each one of the first and second actuating components (7*a*,7*b*) of the driving component (7) may include a protruding component (ex. peg, pin, etc.) being positioned, shaped and sized for engaging a pair of corresponding side slots (17) provided respectively on the first and second transmission components (9*a*,9*b*) of the door-locking mechanism (1), as exemplified in the accompanying drawings.

As can also be easily understood from the figures, the first transmission component (9*a*) may comprise first and second side slots (17*a*,17*b*) configured for cooperating with the first and second actuating components (7*a*,7*b*) of the driving component (7) respectively, and similarly, the second transmission component (9*b*) may comprise first and second side slots (17*a*,17*b*) configured for cooperating with the first and second actuating components of the driving component (7*a*,7*b*) respectively.

According to a possible embodiment of the present system, the first side slot (17*a*) of the first transmission component (9*a*) and the first side slot (17*a*) of the second transmission component (9*b*) share an overlapping segment, and the first actuating component (7*a*) of the driving component (7) is operable within said overlapping segment, as better shown in FIGS. 5-10, for example.

Similarly also, the second side slot (17*b*) of the first transmission component (9*a*) and the second side slot (17*b*) of the second transmission component (9*b*) share an overlapping segment, and the second actuating component (7*b*) of the driving component (7) is operable within said overlapping segment, as also exemplified in FIGS. 5-10.

Optionally also, the first and second transmission components (9*a*,9*b*) may each have a central slot (17*c*), wherein the central slot (17*c*) of the first transmission component (9*a*) and the central slot (17*c*) of the second transmission component (9*b*) share an overlapping segment, and wherein an axial component (7*c*) of the driving component (7) is operable within said overlapping segment.

Figure 4:
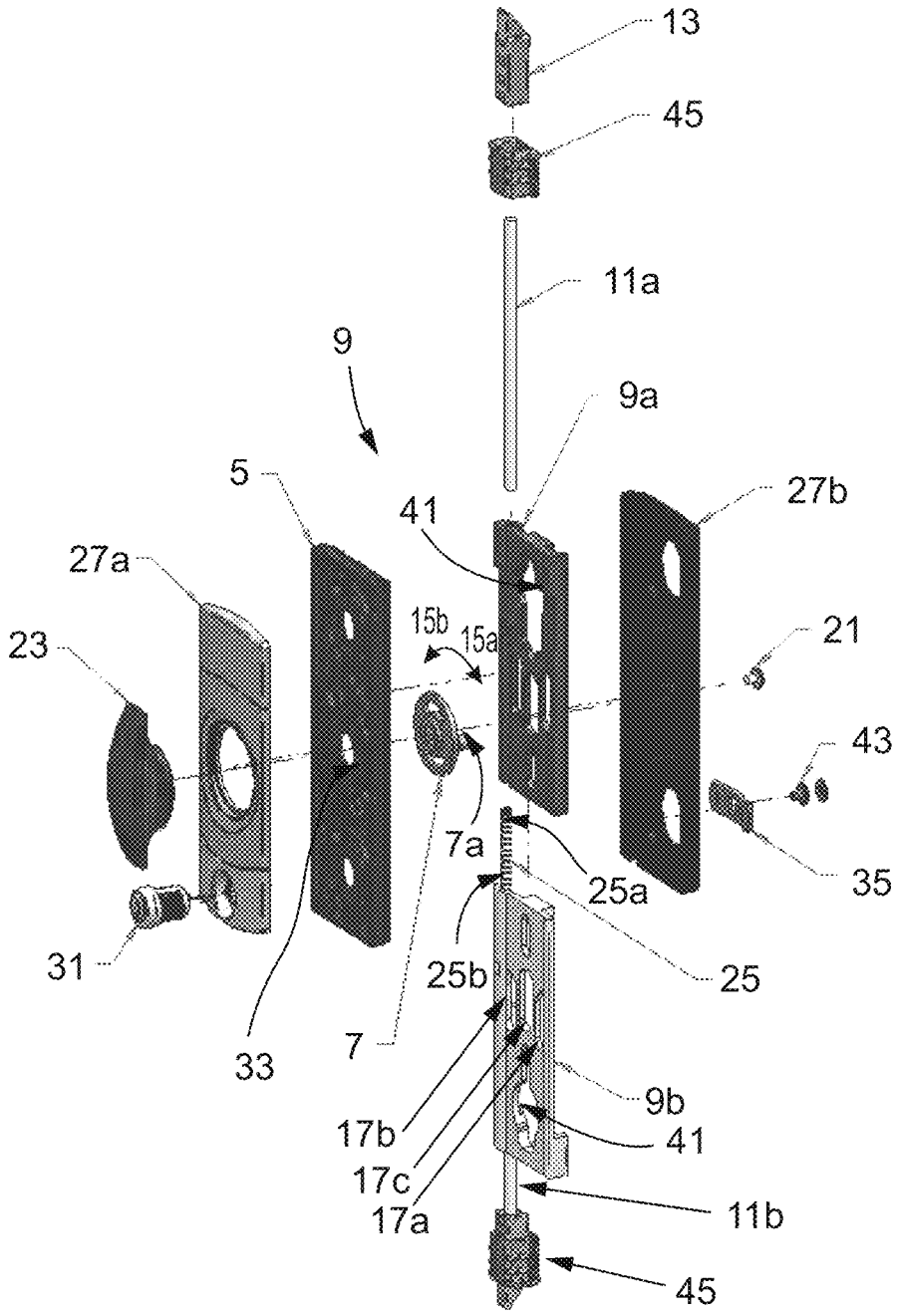
FIG. 4 is an exploded view of the door-locking system shown in FIG. 3.

As exemplified in the accompanying drawings, the axial component (7*c*) of the driving component (7) may include at least one fastener (21), and said at least one fastener (21) may be used for operatively connecting a handle (23) of the door-locking mechanism (1) onto the driving component (7) of the door-locking mechanism (1), in order to allow a manual operation of the driving component (7) via the handle (23), as can be easily understood from FIG. 4, for example.

According to a possible embodiment of the present system, the at least one transmission component (9) comprises upper and lower transmission components (9*a*,9*b*) being operatively mountable with respect to the support component (5), the upper and lower transmission components (9*a*,9*b*) being operable between drawn-in and drawn-out configurations with respect to one another.

As can be easily understood from the accompanying figures, the upper and lower transmission components (9*a*, 9*b*) may be positioned, shaped and sized with respect to one another so as to be freely biased towards the drawn-out configuration, but preferably, the door-locking mechanism (1) comprises a biasing component (25) configured for forcefully biasing the upper and lower transmission components (9*a*,9*b*) towards the drawn-out configuration, as can also be easily understood from FIGS. 4-10, for example.

The biasing component (25) may comprise a resilient device (ex. spring, coil, etc.) having a first extremity (25*a*) operatively pushing against the upper transmission component (9*a*) and a second extremity (25*b*) operatively pushing against the lower transmission component (9*b*) so as to urge the upper and lower transmission components (9*a*,9*b*) away from one another in a default configuration of the door-locking mechanism (1).

According to a possible embodiment of the present system, the default configuration of the door-locking mechanism (1) corresponds to the first configuration of the driving component (7), and the first configuration of the driving component (7) corresponds to an "unlocked" configuration of the door-locking mechanism (1), and the default configuration is meant to be overridden when the driving component (7) is operated into the second configuration, which preferably corresponds to a "locked" configuration of the door-locking mechanism (1) (i.e. when the at least one rod (11) is engaged with the catch-rod (13), etc.).

As can also be easily understood from the accompanying figures, the second configuration of the driving component (7) may include a first locked configuration obtained via a movement of the driving component (7) along a first direction, and the second configuration of the driving component (7) may further include a second locked configuration obtained via a movement of the driving component (7) along a second direction.

However, according to a possible embodiment of the present system, the second configuration of the driving component (7) includes a first locked configuration obtained via a rotation of the driving component (7) along a "clockwise" direction (15*a*), and the second configuration of the driving component (7) further includes a second locked configuration obtained via a rotation of the driving component (7) along an "anticlockwise" direction (15*b*).

As also exemplified in the accompanying figures, the driving component (7) may comprise a hub portion insertable into a corresponding orifice (33) of the support component (5). Optionally also, the door-locking mechanism (1) comprises a handle (23) being operatively connectable to the driving component (7) for manual operation of said driving component (7).

According to a possible embodiment of the present system, the door-locking mechanism (1) comprises a front covering component (27*a*) being operatively mountable onto the support component (5) and being further positioned, shaped and sized for covering a front portion of said support component (5), as well as other inner components of the door-locking mechanism (1), and may also comprise a corresponding rear covering component (27*b*) being operatively mountable onto the support component (5) and being further positioned, shaped and sized for covering a rear portion of said support component (5), as well as other inner components of the door-locking mechanism (1).

As better exemplified in FIGS. 3, 4, 16, 17 and 18, each covering component (27*a*,27*b*) may comprise a plurality of separate sections (29). Namely, each covering component (27*a*,27*b*) may comprise a main section (29*c*) and at least one other complementary section (29*d*) being removably connectable to the main section (29*c*). The at least one other complementary section (29*d*) may be an interchangeable complementary section (29*d*) selected from the group consisting of a complementary section (29*d*) deprived of any orifice (33), and/or a complementary section (29*d*) provided with at least one orifice (33) for receiving a corresponding lock (31) for the door-locking mechanism (1).

Figure 18:
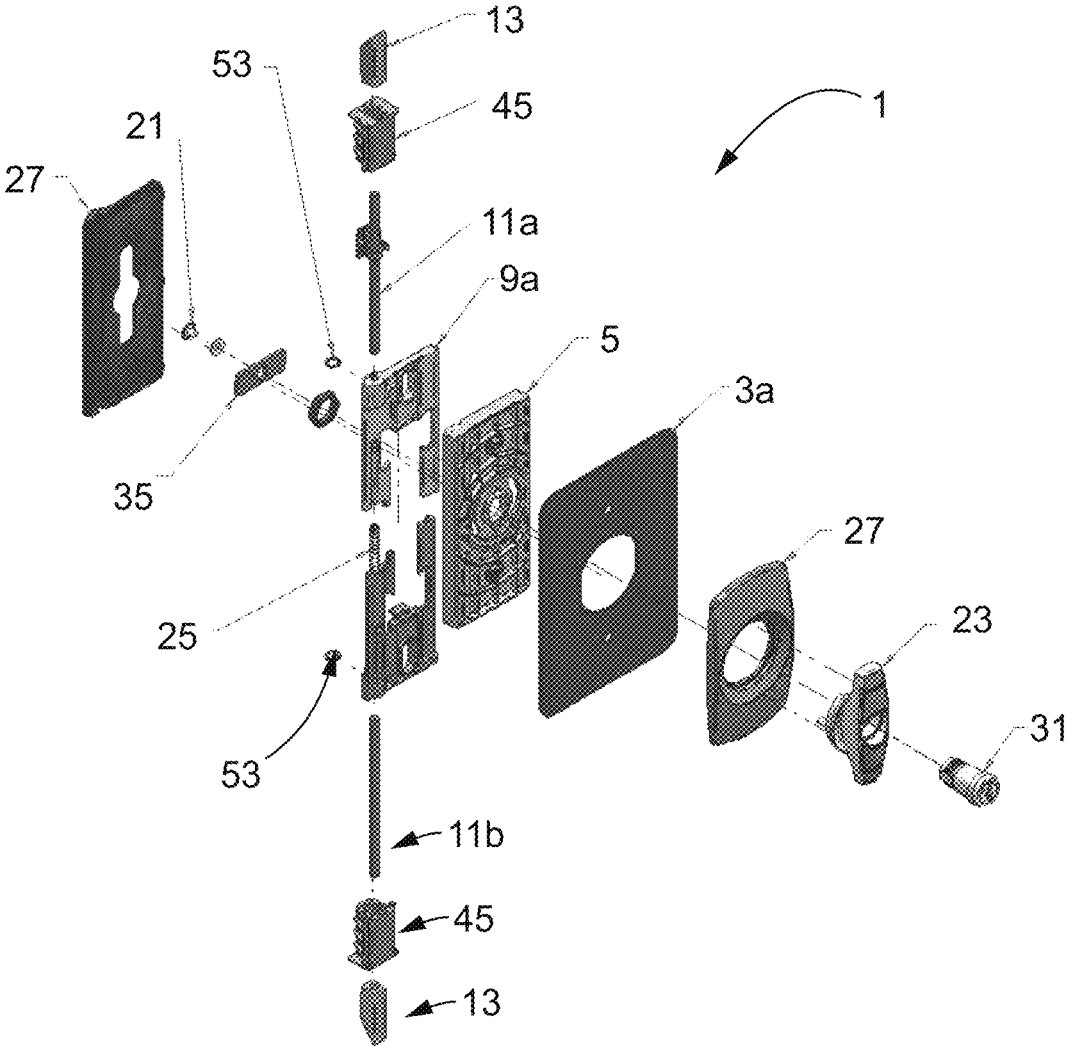
FIG. 18 is an exploded view of a door-locking system according to another possible embodiment of the present invention.
Figure 21:
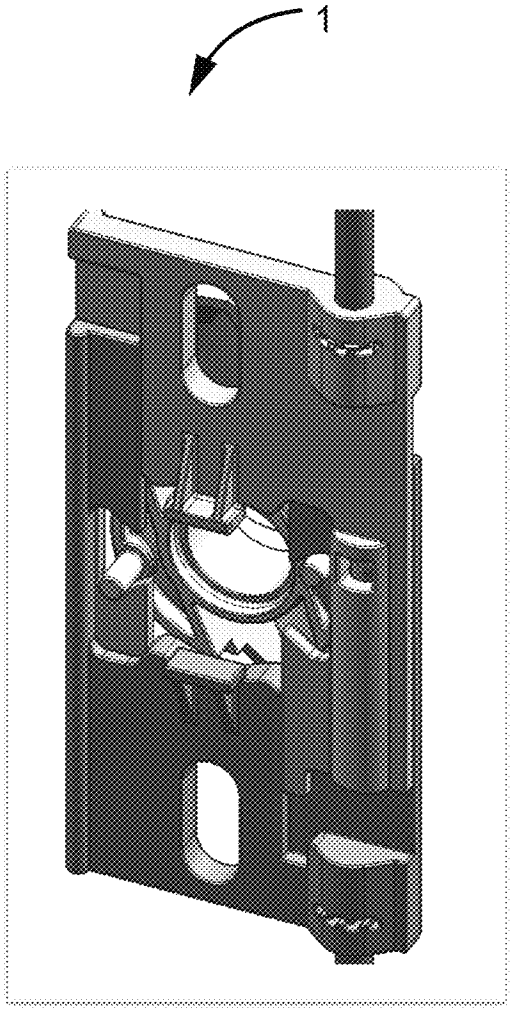
FIG. 21 is another view of what is shown in FIG. 20, the locking system being now shown in an engaged configuration.
Figure 20:
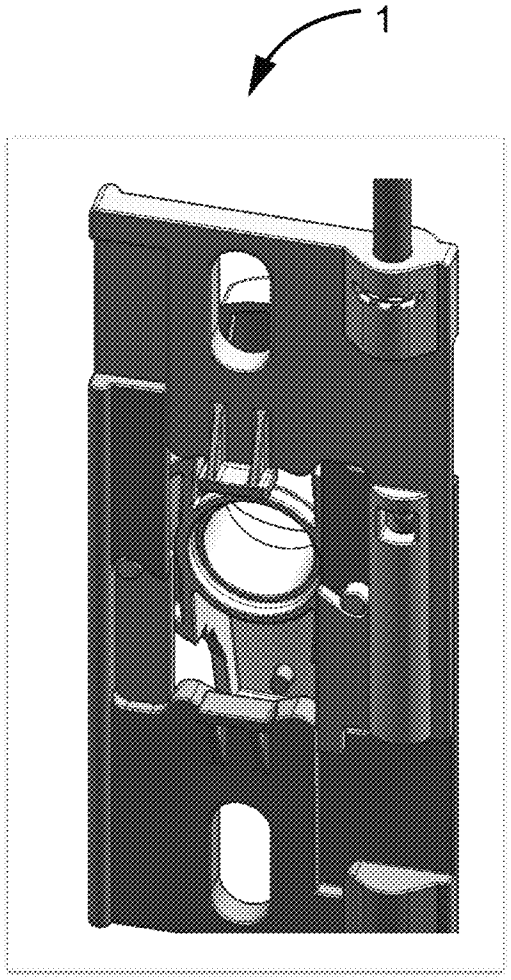
FIG. 20 is a rear perspective view of what is shown in FIG. 19.
Figure 19:
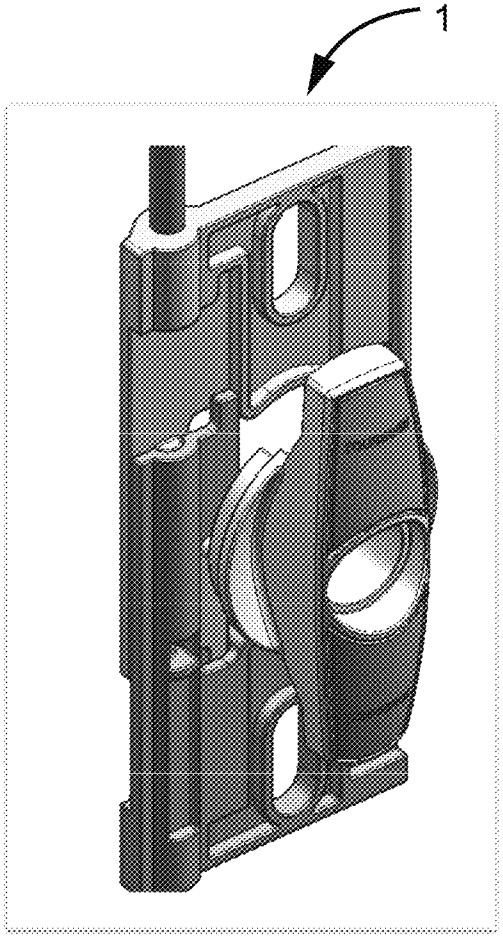
FIG. 19 is a front perspective view of a handle and corresponding transmission components with associated locking rods being shown in a disengaged configuration according to another possible embodiment of the present invention.
Figure 24:
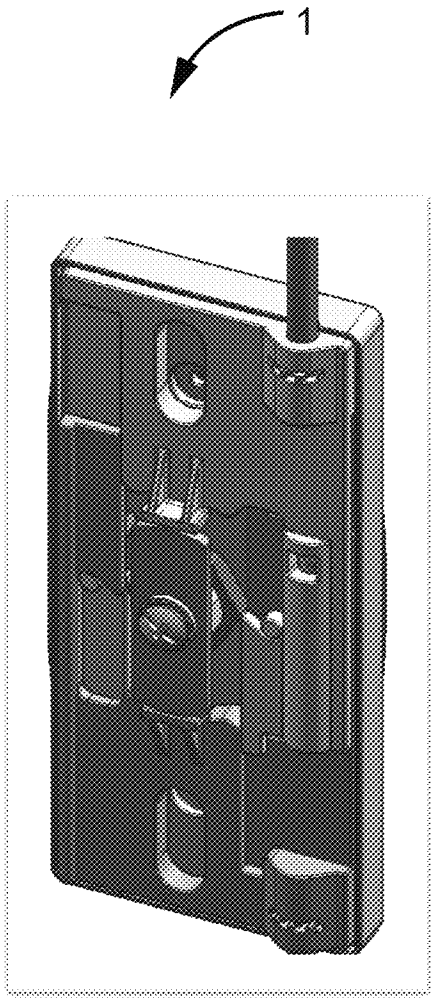
FIG. 24 is another view of what is shown in FIG. 22, the bolt of the lock being now shown in a locking configuration.
Figure 23:
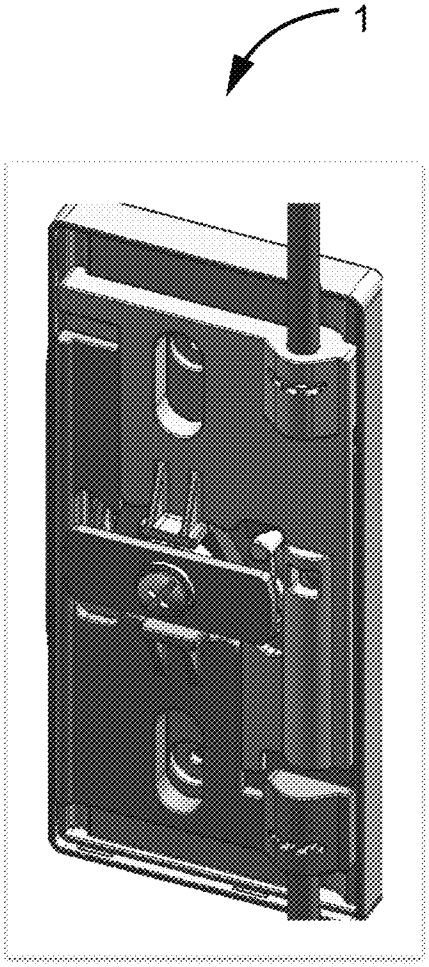
FIG. 23 is another view of what is shown in FIG. 22, the handle being now shown after having been rotated and with the transmission components being shown in a "drawn-in" configuration.
Figure 22:
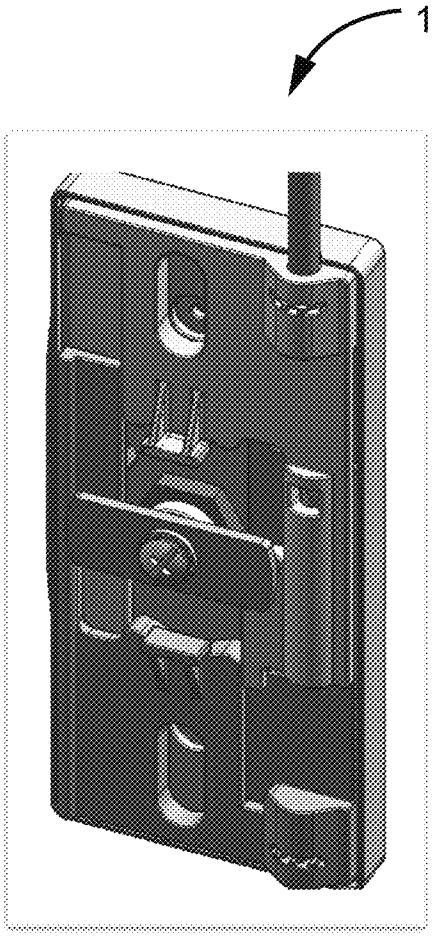
FIG. 22 is a perspective view of transmission components and a corresponding bolt of a lock being shown in an unlocked configuration according another possible embodiment of the present invention.

Also, the main section (29*c*) of the front covering component (27*a*) may comprises at least one orifice (33) being positioned, shaped and sized for receiving therethrough a corresponding handle portion of the door-locking mechanism (1), as better shown in FIGS. 4 and 18, for example.

Optionally, the door-locking mechanism (1) includes at least one lock (31), and the support component (5) comprises at least one corresponding orifice (33) being positioned, shaped and sized for receiving therethrough said at least one lock (31). Each covering component (27*a*,27*b*) may comprise at least one corresponding orifice (33) being positioned, shaped and sized for receiving therethrough said at least one lock (31).

According to a possible embodiment of the present system, the at least one lock (31) includes a bolt (35) being positioned, shaped and sized for preventing opposite transmission components (9*a*,9*b*) of the door-locking mechanism (1) from moving with respect to one another, so as to maintain the at least one locking rod (11) in an "engaged" configuration with the catch-rod (13), when the at least one lock (31) is operated in a "locking" mode, and wherein the bolt (35) is further configured to allow said opposite transmission components (9*a*,9*b*) to be drawn-in towards one another, so as to allow the at least one locking rod (11) to be in a "disengaged" configuration with respect to the catch-rod (13), when the at least one lock (31) is operated in an "unlocked" mode.

Optionally also, each transmission component (9) can have at least one abutment component (37*a*,37*b*) for abutting against a corresponding distal end (35*a*,35*b*) of the bolt (35) when the at least one lock (31) is operated in a locking mode, and according to one possible embodiment, a corresponding abutment component (37*a*,37*b*) of one transmission component (9*a*,9*b*) may be configured for travelling within a corresponding track (41) defined in the other transmission component (9*b*,9*a*), as can be easily understood when referring to the accompanying drawings, namely FIGS. 5-10 and 19-24, for example.

The present door-locking mechanism (1) may comprise at least one fastener (43) used for operatively connecting the bolt (35) to the at least one lock (31), in order to allow a corresponding rotation of bolt (35) when the at least one lock (31) is operated between locking and unlocked modes, as better shown in FIGS. 4 and 18, for example.

As can be easily understood from the accompanying figures, the present door-locking mechanism (1) may simply include just one lower lock (31), just one upper lock (31), or a pair of both lower and upper locks (31). In either case, the support component (5) preferably comprises at least one orifice (33) being positioned, shaped and sized for receiving therethrough each lock (31) of the door-locking mechanism (1).

As can be easily understood from the accompanying figures, the at least one locking rod (11) includes upper and lower locking rods (11*a*,11*b*), each being operatively connectable to a corresponding transmission component (9*a*,9*b*) and each being movable between disengaged and engaged configurations with respect to a corresponding catch-rod (13) of the cabinet (3), in response to transmission components (9*a*,9*b*) being operated between drawn-in and drawn-out configurations, via an operation of the driving component (7).

According to possible embodiment(s) of the present system, and as better exemplified in the drawings: a) each catch-rod (13) may be provided with a catch-rod guide (45); b) each catch-rod guide (45) may be insertable into a corresponding recess (47) defined within the main body (3*b*) of the cabinet (3); c) each catch-rod guide (45) may be also provided with at least one slit (45*a*) configured for receiving therein a corresponding edge (3*c*) of the main body (3*b*) of the cabinet (3); d) each catch-rod guide (45) may be provided with at least one clip (45*b*) configured for engaging a corresponding notch (49) of the main body (3*b*) of the cabinet (3); e) each catch-rod guide (45) may be provided with at least one rib (45*c*) configured for press-fitting the catch-rod guide (45) into the corresponding recess (47) defined within the main body (3*b*) of the cabinet; f) each catch-rod guide (45) may be provided with at least one channel (45*d*) configured for receiving therein a corresponding catch-rod (13).

As described hereinabove, and as illustrated in the accompanying drawings, the present system concerns a locking system for door destined to be activated by means of at least one locking rod (11) via a door-locking mechanism (1), the door-locking mechanism (1) being designed to receive a certain movement, such as a rotational movement, whether this rotational movement is in a "clockwise" or an "anticlockwise" direction.

The door-locking mechanism (1) comprises an internal supporting component (5) configured to be installed onto a door (3*a*), the supporting component (5) being configured for supporting corresponding transmission components (9), as well as other different components, as represented in FIG. 4, for example.

Figure 7:
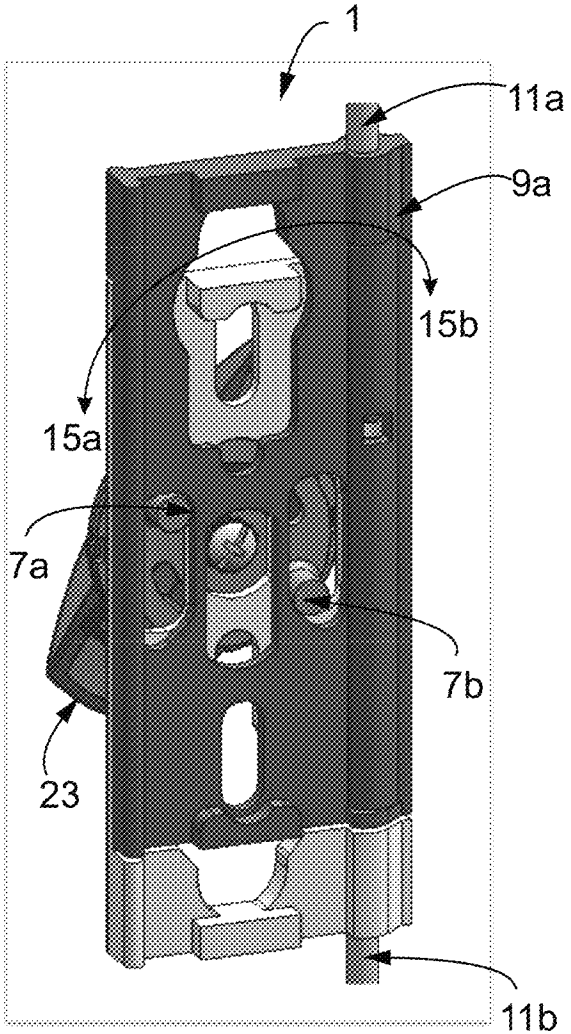
FIG. 7 is another view of what is shown in FIG. 6, the locking system being now shown in an engaged configuration.
Figure 6:
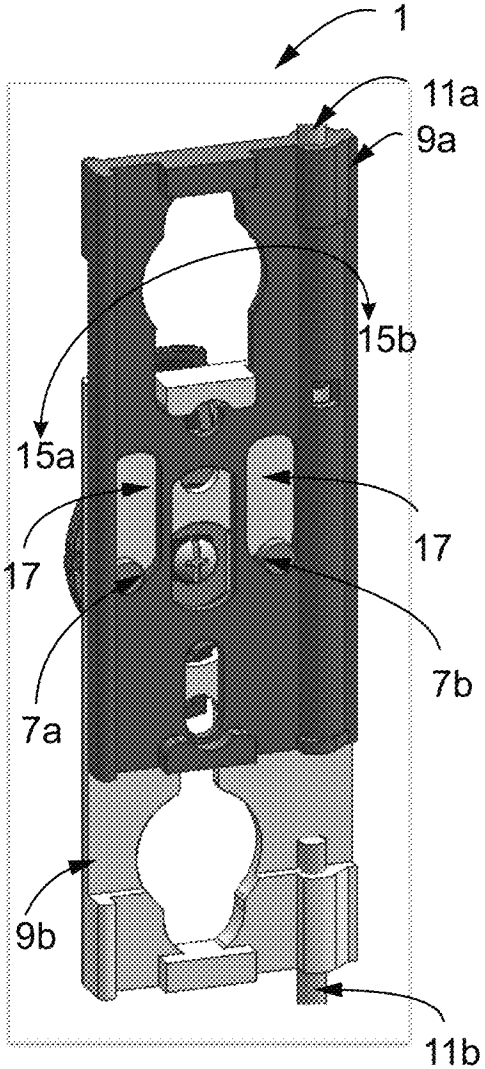
FIG. 6 is a rear perspective view of what is shown in FIG. 5.
Figure 5:
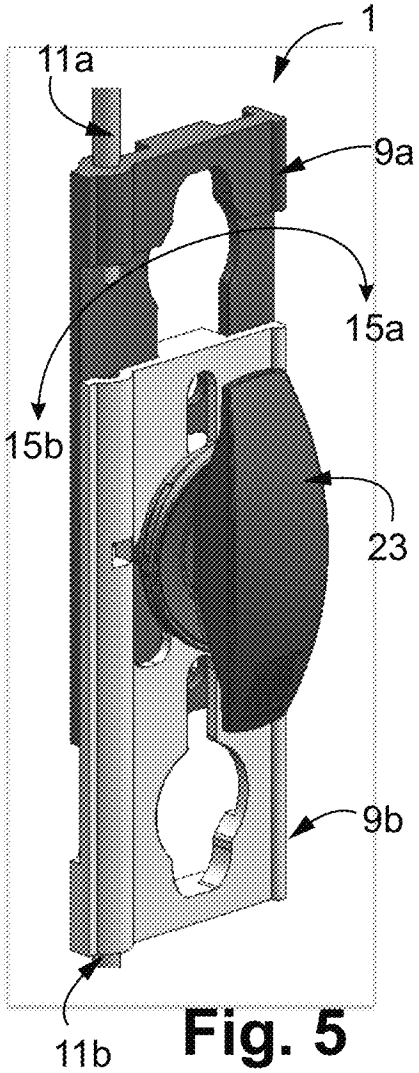
FIG. 5 is a front perspective view of a handle and corresponding upper and lower transmission components with associated locking rods being shown in a disengaged configuration according to a possible embodiment of the present invention.

The transmission components (9), such as activation plates, for example, can be nested into each other and a spring (25) tends to push these plates away from one another in a substantially vertical direction. According to a possible embodiment, these plates may be configured so as to not be drawn away from one another because they could also be retained by two round rods of the activation disk (ex. the driving component (7)), as represented in FIGS. 5 and 6 for example. When the handle (23) is rotated, whether it be in a clockwise or an anticlockwise direction, the round pegs of the activation disk force the activation plates to become closer to one another thereby compressing the spring (25) furthermore, as represented in FIG. 7, for example. This has for an effect to make the locking rods (11) come close to one another, and consequently, away from the catch-rods (13), so as to enable an opening of the door (3*a*). When the handle (23) is released, the spring (25) pushes the plates towards the outside, away from one another, thereby bringing back the plates, the activation disk and the handle, back to their original position.

Figure 10:
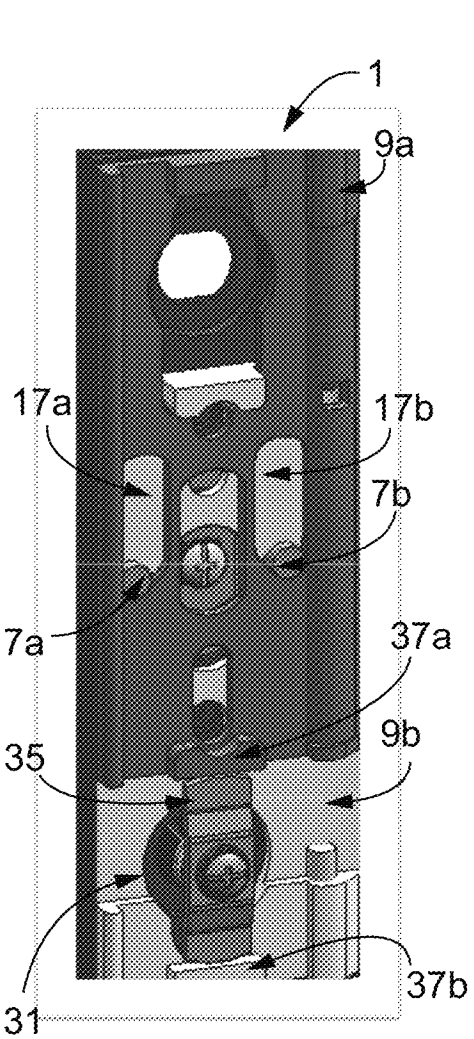
FIG. 10 is another view of what is shown in FIG. 8, the bolt of the lock being now shown in a locking configuration.
Figure 9:
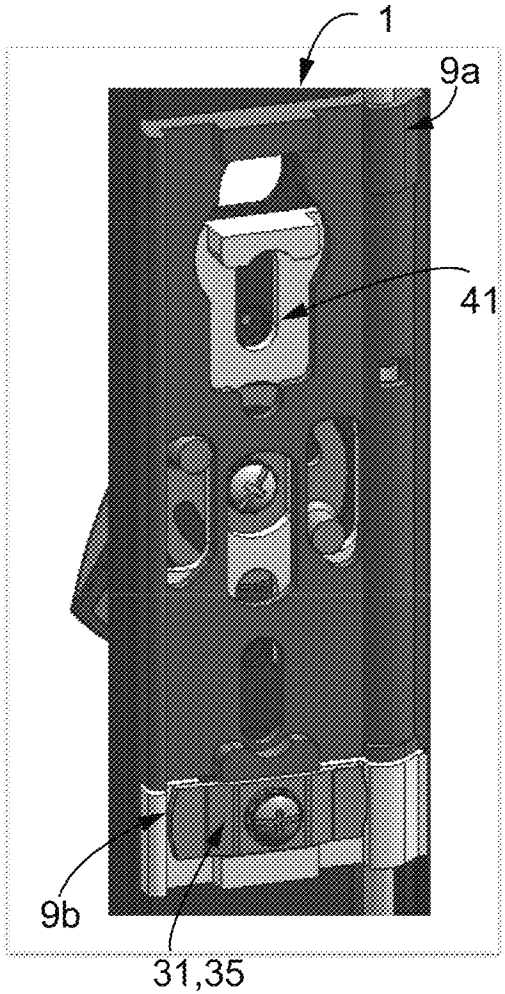
FIG. 9 is another view of what is shown in FIG. 8, the handle being now shown after having been rotated and with the transmission components being shown in a "drawn-in" configuration.
Figure 8:
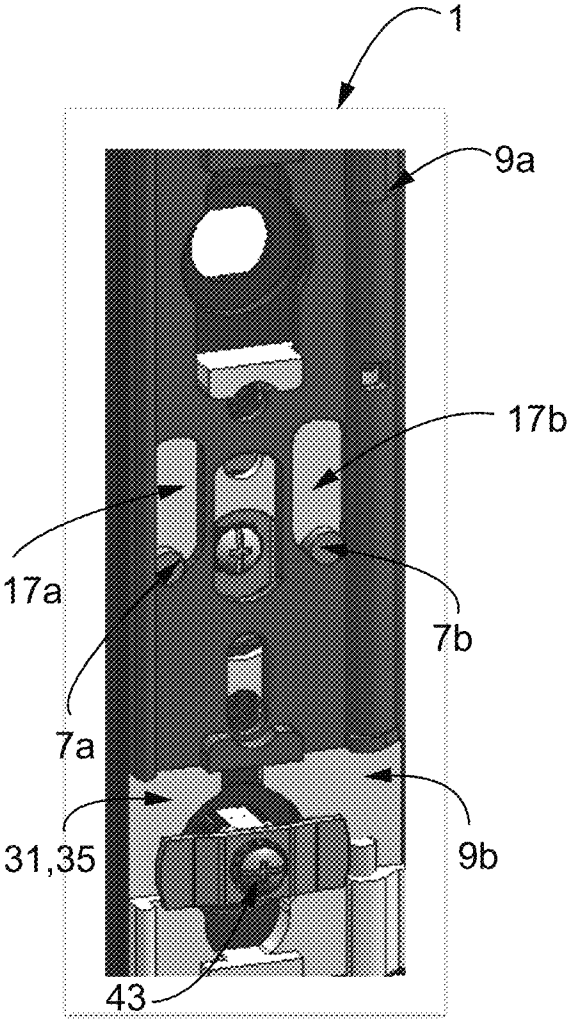
FIG. 8 is a perspective view of upper and lower transmission components and a corresponding bolt of a lock being shown in an unlocked configuration according to a possible embodiment of the present invention.

The locking system is configured to enable the installation of at least one lock (31). FIGS. 8 to 10 show the operation of a possible lock assembly. In FIG. 8, the handle (23) is unlocked and it is at its free configuration or position. In this free position, there is a play between the bolt (35) and the activation plates. This "play" or "wiggle room" enables the activation plates to become closer to one another when the handle is activated, as represented in FIG. 9. However, when the lock (31) is in a locking configuration, the bolt (35) finds itself in a substantially vertical position, and thereby generally impedes any movement of the activation plates, as shown in FIG. 10. In the locking configuration, the handle (23) is preferably designed so as to not be able to rotate. The present system is also designed so that it may not be possible to push the catch-rods (13) from the locking rods (11) to make them go in, and unlock the door (3*a*).

Figure 12:
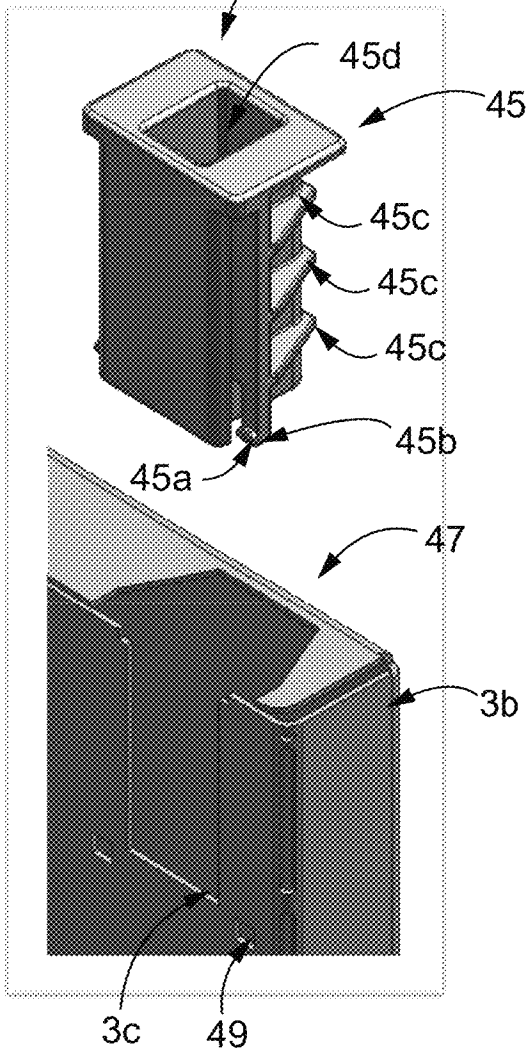
FIG. 12 is an exploded view of what is shown in FIG. 11, the catch-rod guide being now shown removed from the door in order to better appreciate a possible design of the catch-rod guide which enables to assemble it quickly and by clipping according to a possible embodiment of the present invention.
Figure 11:
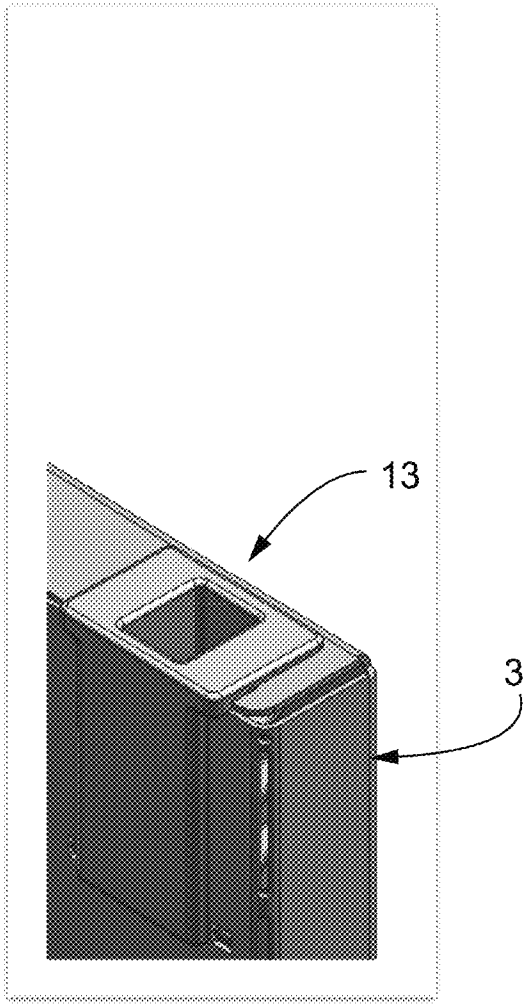
FIG. 11 is a partial perspective view of a portion of a door being provided with a catch-rod guide assembled into the door according to a possible embodiment of the present invention.

According to a possible embodiment, the catch-rods (13) are guided in the top portion and in the bottom portion of the door (3*a*) by the catch-rod guides (45). These catch-rod guides (45) have a geometry that enables to assemble them and put them in place quickly (ex. by clipping, for example), as represented in FIGS. 11 and 12.

Figure 13:
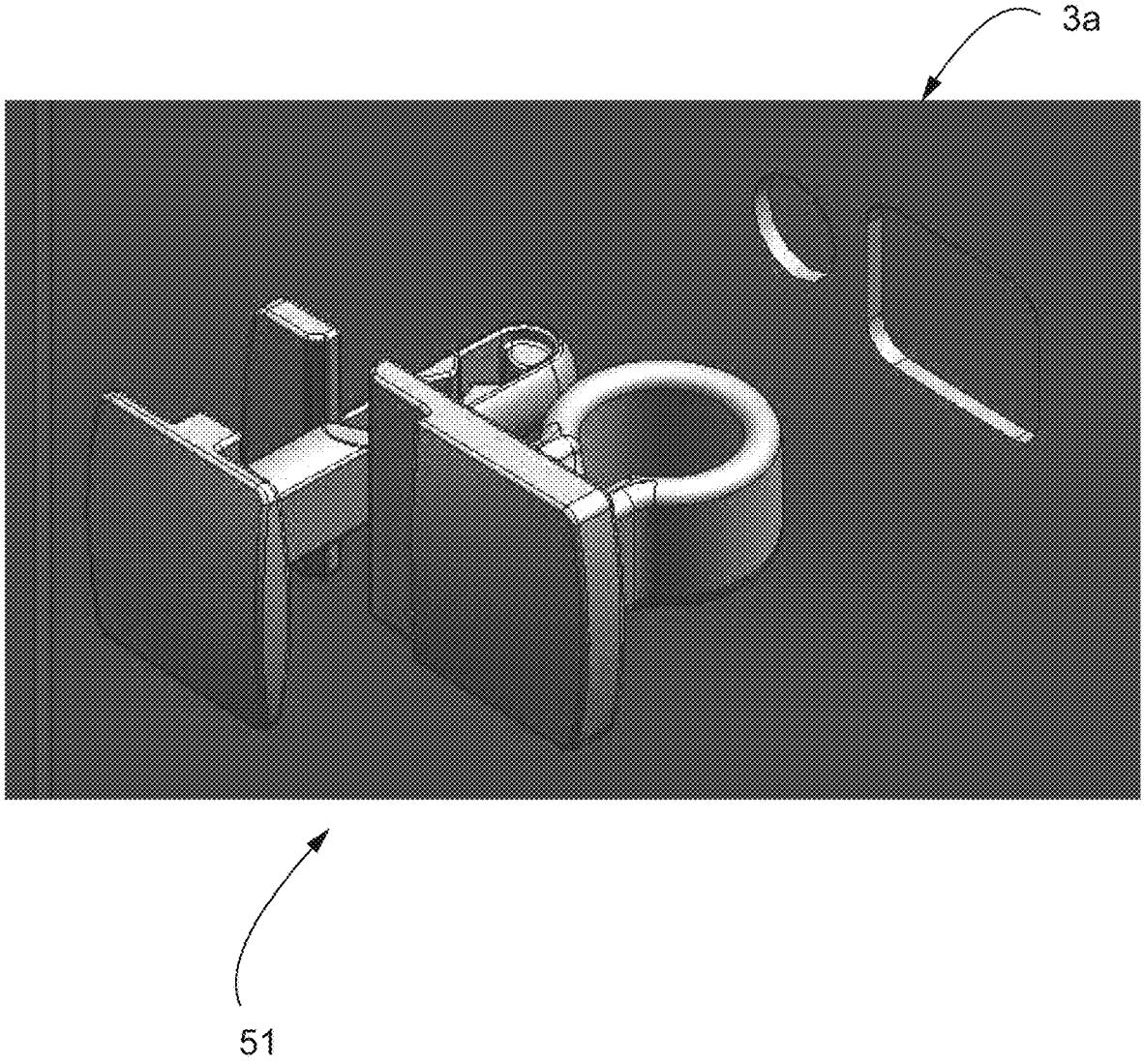
FIG. 13 is an exploded view of a guiding clip shown with respect to corresponding holes of an inner wall of a door according to a possible embodiment of the present invention.

For doors of greater dimensions, the locking rods (11) can be substantially long. In the case of conventional systems, the locking rods may oscillate with the vibrations of the door, thereby hitting the walls of the door and generating undesirable noise. In the present case, a special guide clip (51) has been designed for the locking rods, as represented in FIG. 13. This clip (51) can be inserted in a hole of the internal wall of the door (3*a*). One simply has to hit by means of an appropriate tool, such as a hammer, or any other suitable tool, on the head of the clip (51 (in order to break a connecting element that finds itself in the internal part of the clip, thereby making it expand afterwards internally behind the door, for a proper "anchoring". The clip (51) is thereby held in place in the door (3*a*) and enables the locking rods (11) to be inserted therein.

Figure 15:
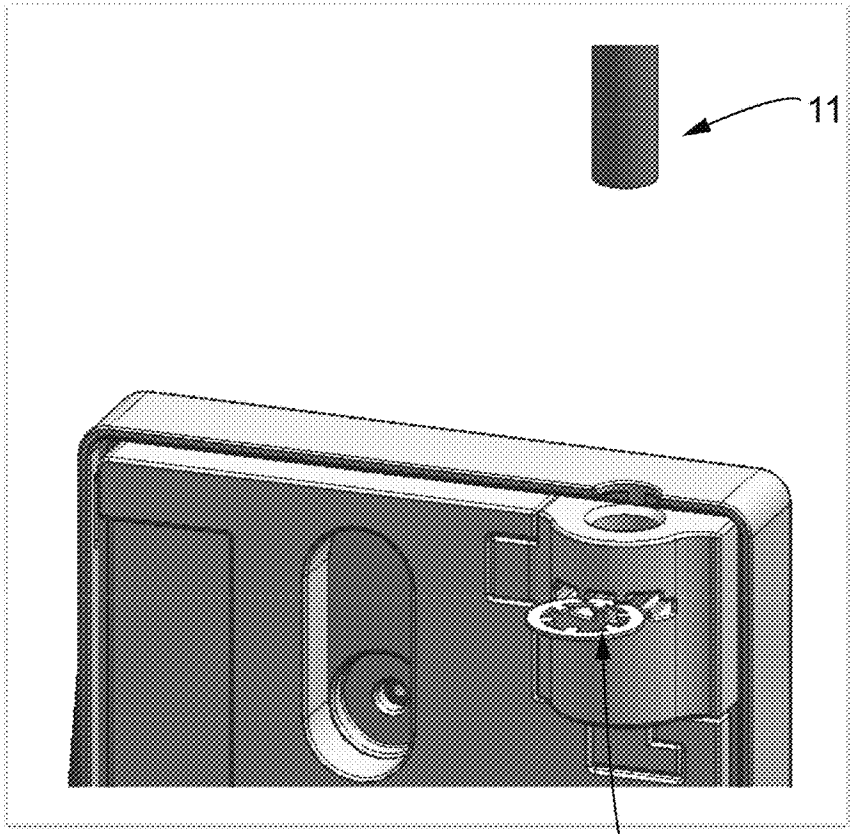
FIG. 15 is another view of what is shown in FIG. 14, some components having been removed in order to better appreciate certain internal components of the system.
Figure 14:
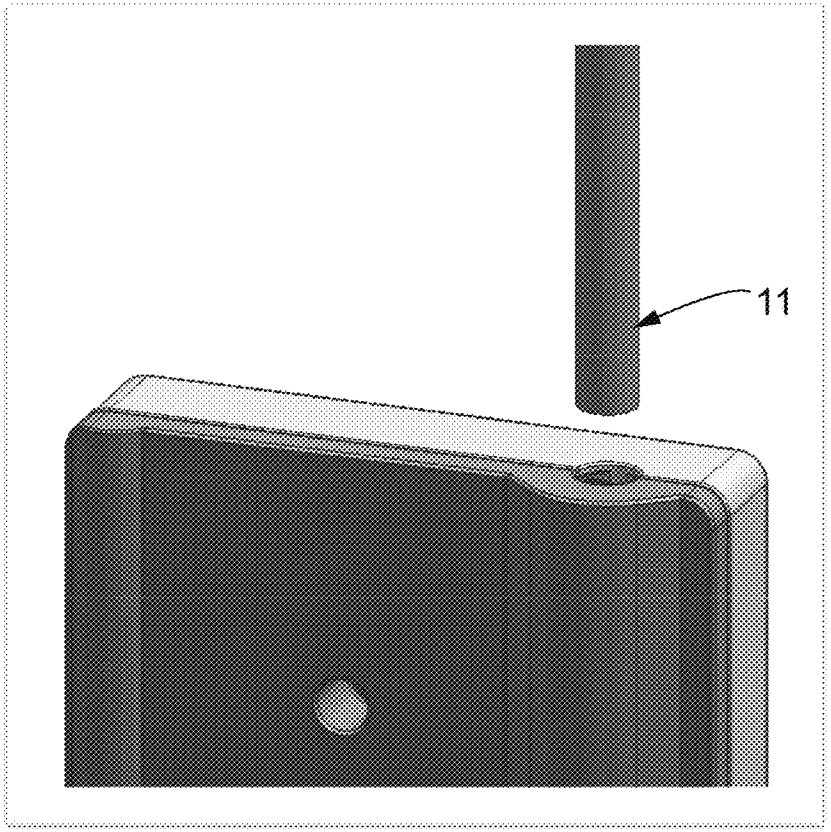
FIG. 14 is a partial rear perspective view of a locking system showing a corresponding locking rod being detached according to a possible embodiment of the present invention.
Figure 17:
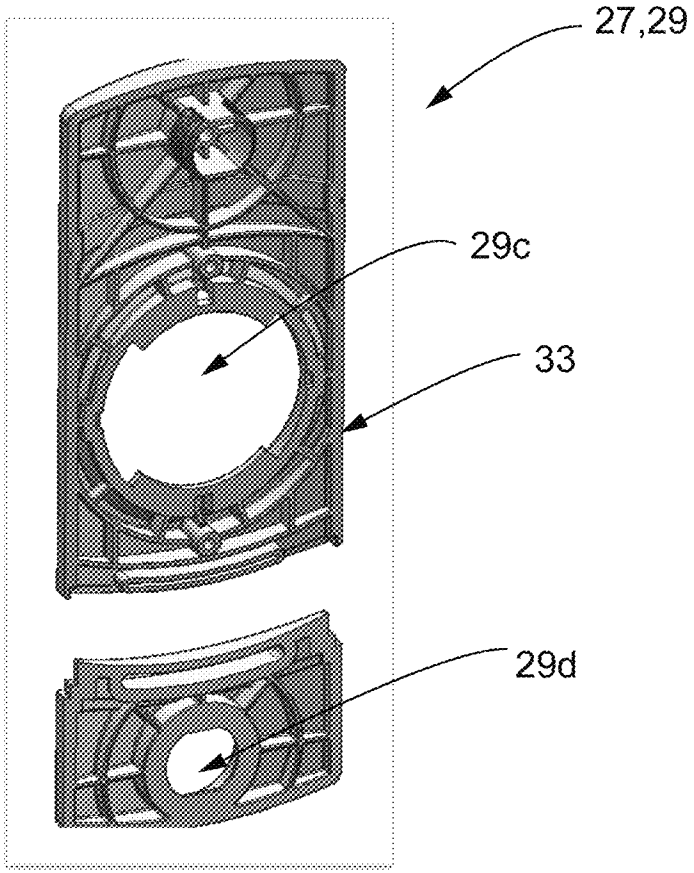
FIG. 17 is a rear view of what is shown in FIG. 16.

According to another possible embodiment of the present invention, the locking rods (11) are installed in the activation plates by means of a retaining ring (53), as represented in FIG. 15. The ring (53) is inserted before closing or mounting the rear covering component (27*b*), as represented in FIG. 14. During the installation of the mechanism, the locking rods are inserted in the holes of the casing and become fixedly attached to the activation plates. The installation of the rods (11) is thus carried out according to the present system in a very quick, and easy manner, without the need for tools.

It is also possible to disassemble the locking rods (11) in case of repair, maintenance, or for any other reasons. The portion of the activation plates in which the retaining ring (53) is inserted can thus be easily attached from the rest of the assembly similarly to a "jigsaw puzzle". It is therefore possible to open up the rear covering component (27*b*) and to detach the "jigsaw puzzle" piece at the same time as the rod (11) and to proceed to the replacement before putting the rear covering component (27*b*) back again.

An alternative method is also contemplated from the present system for the installation of rods (11). One simply has to simply machine a corresponding slit at the extremity of the activation rods (11) and corresponding clipping tabs in the holes of the activation plates. This would add a machining operation on the rods (11) but would facilitate the assembling of the mechanism (1) and the removal of the rods (11) in case of having a broken one, etc.

Figure 16:
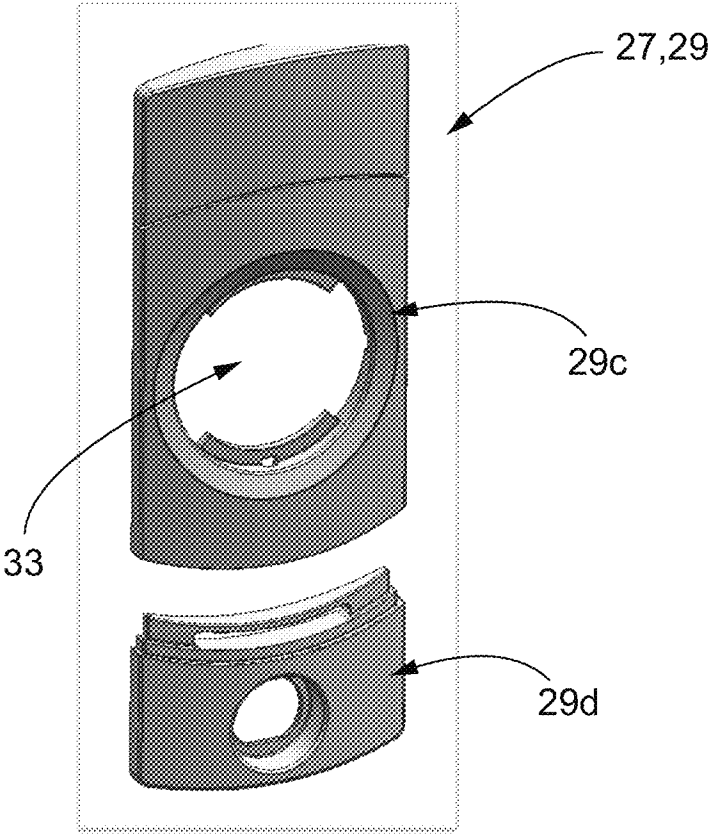
FIG. 16 is a front perspective view of a front covering component with one of the sections being shown in a detached configuration according to a possible embodiment of the present invention.

Finally, as previously discussed, a front covering component (27*a*) can be installed in order to cover the system. The front covering component (27*a*) can be, for example, composed of a central or main section (29*c*) and of two other plates (29*d*), an upper plate and a lower plate, as represented in FIG. 16. The two plates (29*d*) can be interchangeable, demountable and available in different models, shapes and sizes. For example, one may have a plate (29*d*) with an orifice (33) for the lock (31), as represented in the lower portion of FIG. 16, or one may also have a "full" or "closed" plate (29*d*), as represented in the upper portion of FIG. 16, or even another plate (29*d*) representing an identification of "Rousseau" (i.e. the name of the Applicant of the present patent application) and/or or any other appropriate and/or desirable identification (name of company having purchased the door, name of manufacturer of the product, name of distributor, visual information, warnings, etc.). It is thus possible to combine at will these different plates (29*d*) on the handle in order to obtain different versions, whether a handle without lock, a handle with only one lock (31), or a handle with two locks (31). The rest of the mechanism (1) can be designed in order to operate with the corresponding number of lock(s) (31) being used, as represented in FIG. 8. This enables namely a door to have two distinct locks (31) requiring to different keys in order to access the content of the storage space. It is also possible to have handles that are provided (or not) with the identification "Rousseau".

As may now be better appreciated, the present invention presents several advantages with respect to conventional systems in that, for example: a) the mechanism (1) can be activated by pivoting the handle (23) either in the clockwise or the anticlockwise direction; b) the locking rods (11) can simply be straight rods, without requiring the need of bending them—this greatly simplifies the manufacturing of the rods, and also reduces considerably the associated costs, and also prevents the rods from oscillating, thereby avoiding undesirable noise; c) for doors of greater dimensions, the present system also offers the possibility of adding a guiding clip (51) in order to avoid vibrations that may occur in the locking rods (11); d) it is not necessary to activate the handle (23) in order to close the door. The optional design of the activation plate having been described herein, it is intended so as to allow the rods (11) to go into the corresponding catch-rods (13) under the pushing effect of the resilient device (25) without one having to necessarily manually activate the handle (23). The activation plates are designed so as to be biased in order to be drawn-in towards one another under the effect of the push of the rods (11) and then take their position under the influence of the spring (25); and e) the set of pieces formed in the inside portion of the door is very compact which enables the present system to be used in relatively thin doors.

Thus, in view of the above, and as may now be better appreciated, the present door-locking system and/or mechanism (1) is advantageous over other related door-locking devices and/or methods in that it enables to "lock" a corresponding door of a storage container, such as cabinet for example, with respect to a main body of the storage container, in a much simpler, easier, faster, more convenient, and/or more versatile manner than what is possible with other conventional systems.

Finally, and as can be easily understood, the door-locking system and/or mechanism (1) and corresponding parts can be made of substantially rigid materials, such as metallic materials, hardened polymers, composite materials, and/or the like, as well as other possible combinations thereof, depending on the particular applications for which the door-locking system and/or mechanism (1) is intended for, and the desired end results.

Of course, and as can be easily understood by a person skilled in the art, the scope of the claims should not be limited by the possible embodiments set forth in the examples, but should be given the broadest interpretation consistent with the description as a whole.

The invention claimed is:

1. A door-locking mechanism for locking a door of a cabinet with respect to a main body of said cabinet, the door-locking mechanism comprising:

a supporting component being operatively mountable onto the door;

a driving component being operatively moveable with respect to the supporting component between at least first and second configurations;

at least one transmission component being operatively moveable with respect to the supporting component between drawn-in and drawn-out configurations; and at least one locking rod being operatively connectable to the at least one transmission component and being movable between disengaged and engaged configurations with respect to a corresponding catch-rod of the cabinet, in response to the at least one transmission component being operated between the drawn-in and drawn-out configurations respectively, via an operation of the driving component from the first to the second configuration;

wherein the door-locking mechanism includes at least one lock, and wherein the supporting component comprises at least one corresponding orifice being positioned, shaped and sized for receiving therethrough said at least one lock; wherein each covering component comprises at least one corresponding orifice being positioned, shaped and sized for receiving therethrough at least one lock; wherein said at least one lock includes a bolt being positioned, shaped and sized for preventing opposite transmission components of the door-locking mechanism from moving with respect to one another, so as to maintain the at least one locking rod in an engaged configuration with the catch-rod when the at least one lock is operated in a locking mode; and wherein the bolt is configured to allow said opposite transmission components to be drawn-in towards one another, so as to allow the at least one locking rod to be in a disengaged configuration with respect to the catch-rod when the at least one lock is operated in an unlocked mode; wherein each transmission component has at least one abutment component for abutting against a corresponding distal end of the bolt when the at least one lock is operated in a locking mode; wherein a corresponding abutment component of one transmission component is configured for travelling within a corresponding track defined in the other transmission component wherein the door-locking mechanism comprises at least one fastener used for operatively connecting the bolt to the at least one lock, in order to allow a corresponding rotation of bolt when the at least one lock is operated between locking and unlocked modes; wherein the at least one lock is selected from the group consisting of a lower lock, an upper lock, and a pair of both lower and upper locks; and wherein the supporting component comprises at least one orifice being positioned, shaped and sized for receiving therethrough each lock of the door-locking mechanism.

2. A door-locking mechanism according to claim 1, wherein the driving component is pivotably mountable with respect to the supporting component, and wherein the driving component is rotatable with respect to said supporting component along at least one direction selected from a first direction and an opposite and second direction; wherein the driving component comprises a first actuating component positioned, shaped and sized for engaging a corresponding portion of a first transmission component of the door-locking mechanism; wherein the first actuating component of the driving component includes a male component insertable into a corresponding female component of the first transmission component of the door-locking mechanism; and wherein alternatively, the first actuating component of the driving component includes a female component configured for receiving a corresponding male component of the first transmission component.

3. A door-locking mechanism according to claim 1, wherein the driving component comprises a first actuating component positioned, shaped and sized for engaging a corresponding portion of a first transmission component of the door-locking mechanism, and wherein the driving component comprises a second actuating component positioned, shaped and sized for engaging a corresponding portion of a second transmission component of the door-locking mechanism.

4. A door-locking mechanism according to claim 3, wherein the second actuating component of the driving component includes a male component insertable into a corresponding female component of the second transmission component of the door-locking mechanism; wherein the second actuating component of the driving component includes a female component configured for receiving a corresponding male component of the first transmission component; wherein each one of the first and second actuating components of the driving component is further positioned, shaped and sized for engaging a corresponding portion of both the first and second transmission components of the door-locking mechanism; and wherein each one of the first and second actuating components of the driving component includes a protruding component being positioned, shaped and sized for engaging a pair of corresponding side slots provided respectively on the first and second transmission components of the door-locking mechanism.

5. A door-locking mechanism according to claim 3, wherein the second transmission component comprises first and second side slots configured for cooperating with the first and second actuating components of the driving component respectively.

6. A door-locking mechanism according to claim 5, wherein the first side slot of the first transmission component and the first side slot of the second transmission component share an overlapping segment, and wherein the first actuating component of the driving component is operable within said overlapping segment; and wherein the second side slot of the first transmission component and the second side slot of the second transmission component share an overlapping segment, and wherein the second actuating component of the driving component is operable within said overlapping segment.

7. A door-locking mechanism according to claim 3, wherein the first and second transmission components each have a central slot, wherein the central slot of the first transmission component and the central slot of the second transmission component share an overlapping segment, and wherein an axial component of the driving component is operable within said overlapping segment; wherein the axial component of the driving component includes at least one fastener; and wherein said at least one fastener is used for operatively connecting a handle of the door-locking mechanism onto the driving component of the door-locking mechanism, in order to allow manual operation of the driving component via the handle.

8. A door-locking mechanism according to claim 1, wherein the at least one transmission component comprises upper and lower transmission components being operatively mountable with respect to the supporting component, and wherein the upper and lower transmission components are operable between drawn-in and drawn-out configurations with respect to one another.

9. A door-locking mechanism according to claim 8, wherein the upper and lower transmission components are positioned, shaped and sized with respect to one another so as to be freely biased towards the drawn-out configuration.

10. A door-locking mechanism according to claim 8, wherein the door-locking mechanism comprises a biasing component configured for forcefully biasing the upper and lower transmission components towards the drawn-out configuration.

11. A door-locking mechanism according to claim 10, wherein the biasing component comprises a resilient device having a first extremity operatively pushing against the upper transmission component and a second extremity operatively pushing against the lower transmission component so as to urge the upper and lower transmission components away from one another in a default configuration of the door-locking mechanism.

12. A door-locking mechanism according to claim 11, wherein the default configuration of the door-locking mechanism corresponds to the first configuration of the driving component; wherein the first configuration of the driving component corresponds to an locked configuration of the door-locking mechanism; and wherein the default configuration is overridden when the driving component is operated in the second configuration.

13. A door-locking mechanism according to claim 1, wherein the door-locking mechanism comprises a front covering component being operatively mountable onto the supporting component and being further positioned, shaped and sized for covering a front portion of said supporting component, as well as other inner components of the door-locking mechanism.

14. A door-locking mechanism according to claim 1, wherein the door-locking mechanism comprises a rear covering component being operatively mountable onto the supporting component and being further positioned, shaped and sized for covering a rear portion of said supporting component, as well as other inner components of the door-locking mechanism.

15. A door-locking mechanism according to claim 13, wherein each covering component comprises a main section and at least one other complementary section being removably connectable to the main section; wherein the main section of the front covering component comprises at least one orifice being positioned, shaped and sized for receiving therethrough a corresponding handle portion of the door-locking mechanism; and wherein said at least one other complementary section is an interchangeable complementary section selected from the group consisting of:

a complementary section deprived of any orifice; and a complementary section provided with at least one orifice for receiving a corresponding lock for the door-locking mechanism.

16. A door-locking mechanism according to claim 1, wherein the at least one locking rod includes upper and lower locking rods each being operatively connectable to a corresponding transmission component and each being movable between disengaged and engaged configurations with respect to a corresponding catch-rod of the cabinet, in response to transmission components being operated between drawn-in and drawn-out configurations, via an operation of the driving component.

17. A door-locking mechanism according to claim 1, wherein each catch-rod is provided with a catch-rod guide; wherein each catch-rod guide is insertable into a corresponding recess defined within the main body of the cabinet; wherein each catch-rod guide is provided with at least one slit configured for receiving in the slit a corresponding edge of the main body of the cabinet; wherein each catch-rod guide is provided with at least one clip configured for engaging a corresponding notch of the main body of the cabinet; wherein each catch-rod guide is provided with at least one rib configured for press-fitting the catch-rod guide into the corresponding recess defined within the main body of the cabinet; and wherein each catch-rod guide is provided with at least one channel configured for receiving therein a corresponding catch-rod.

* * * * *